United States Patent [19]

Carey

[11] Patent Number: 5,029,448

[45] Date of Patent: Jul. 9, 1991

[54] OIL SEPARATOR FOR REFRIGERATION SYSTEMS

[75] Inventor: Michael D. Carey, Holmen, Wis.

[73] Assignee: American Standard Inc., New York, N.Y.

[21] Appl. No.: 468,653

[22] Filed: Jan. 23, 1990

[51] Int. Cl.[5] ..... F25B 32/02

[52] U.S. Cl. ..... 62/84; 62/470

[58] Field of Search ..... 62/84, 468, 470

[56] References Cited

U.S. PATENT DOCUMENTS

| | | | |
|---|---|---|---|
| 2,097,725 | 11/1937 | Gay | 62/470 |
| 3,151,961 | 10/1964 | Blackmore et al. | 55/205 |
| 3,161,490 | 12/1964 | Dudek | 55/205 |
| 3,520,149 | 7/1970 | Uratani | 62/470 |
| 3,778,984 | 12/1973 | Lawser | 55/333 |
| 4,070,166 | 1/1978 | Emanuelsson | 55/41 |
| 4,329,854 | 5/1982 | Schmidt | 62/84 |
| 4,472,949 | 9/1984 | Fujisawa et al. | 62/473 |
| 4,478,050 | 10/1984 | DiCarlo et al. | 62/193 |
| 4,506,523 | 3/1985 | DiCarlo et al. | 62/470 |
| 4,622,048 | 11/1986 | Roberts et al. | 55/199 |
| 4,662,190 | 5/1987 | Tischer | 62/470 |
| 4,741,177 | 5/1988 | Glanvall | 62/470 |
| 4,750,337 | 6/1988 | Glamm | 62/468 |

*Primary Examiner*—Ronald C. Capossela

*Attorney, Agent, or Firm*—William J. Beres; William O'Driscoll

[57] ABSTRACT

An oil separator for an air-cooled refrigeration system employing a screw compressor includes a U-shaped housing the bottom of which defines an oil sump and the upstanding leg portions of which are connected by flow splitting apparatus. The flow splitting apparatus divides and tangentially delivers portions of a mixture of compressed refrigerant gas received from the compressor, and in which oil is entrained, into the upper region of each leg portion. The tangential delivery of the mixture into the leg portions and the centrifugal force created thereby causes the entrained oil to be separated from the gas at two distinct locations in the separator. The separated oil drains along the inner walls of the leg portions of the separator to a common sump while the compressed refrigerant gas from which the oil has been separated exits each of the leg portions through open-ended conduits which extend into the leg portions.

20 Claims, 2 Drawing Sheets

OIL SEPARATOR FOR REFRIGERATION SYSTEMS

BACKGROUND OF THE INVENTION

The present invention relates generally to the art of compressing a gas. More particularly, the present invention relates to the compression of a refrigerant gas into which a liquid is injected during the compression process.

With still more particularity, this invention relates to the requirement to separate entrained injected oil from the oil-gas mixture discharged from a screw compressor in a refrigeration system.

Compressors are used in refrigeration systems to raise the pressure of a refrigerant gas from a suction to a discharge pressure thereby permitting the refrigerant to be used within the circuit to cool a desired medium. Many types of compressors, including rotary screw compressors, are employed to compress the refrigerant gas in a refrigeration system.

In a screw compressor two complimentary rotors are located in a housing having a low pressure end, which defines a suction port, and a high pressure end, which defines a discharge port. Refrigerant gas at suction pressure enters the low pressure end of the compressor housing and is there enveloped in a pocket formed between the counter-rotating screw rotors.

The volume of the gas pocket decreases and the pocket is circumferentially displaced as the compressor rotors rotate and mesh. The gas within such a pocket is compressed and heated by virtue of the decreasing volume in which it is contained prior to the pocket's opening to the discharge port. The pocket, as it continues to decrease in volume, eventually opens to the discharge port in the high pressure end of the compressor housing and the compressed gas is discharged from the compressor.

Screw compressors used in refrigeration applications will, in the large majority of instances, include an oil injection feature. Oil is injected, in relatively large quantity, into the working chamber of a screw compressor (and therefore into the refrigerant gas being compressed therein) for several reasons. First, the injected oil acts to cool the refrigerant gas undergoing compression. As a result, the compressor rotors are likewise cooled allowing for tighter tolerances between the rotors.

Second, the oil acts as a lubricant. One of the two rotors in the screw compressor is typically driven by an external source, such as an electric motor, with the other rotor being driven by virtue of its meshing relationship with the externally driven rotor. The injected oil prevents excessive wear between the driving and driven rotors. The oil is additionally delivered to various bearing surfaces within the compressor for lubrication purposes.

Finally, oil injected into the working chamber of a screw compressor acts as a sealant between the meshing rotors and between the rotors and the working chamber in which they are housed for the reason that there are no discrete seals in a screw compressor between the individual rotors or between the rotors and the rotor housing. Absent the injection of oil, significant leakage paths would exist internal of the compressor which would be detrimental to compressor efficiency. Oil delivery and injection therefore both increases the efficiency and prolongs the life of a screw compressor.

Oil making its way into the working chamber of a screw compressor is, for the most part, atomized and becomes entrained in the refrigerant undergoing compression. Such oil, to a great extent, must be removed from the oil-rich mixture discharged from the compressor in order to make the oil available for reinjection into the compressor for the purposes enumerated above. Further, removal of excess oil from the compressed refrigerant gas must be accomplished to ensure that the performance of the refrigerant gas is not unduly affected within the refrigeration system by the carrying of an excess amount of oil into and through system heat exchangers.

The need therefore continues to exist for reliable and efficient oil separation apparatus for screw compressor refrigeration systems which removes a predetermined and required amount of oil from the oil-refrigerant gas mixture discharged by the compressor.

SUMMARY OF THE INVENTION

It will be appreciated that it is an object of this invention to separate an entrained liquid, such as oil, from a liquid-refrigerant gas mixture.

It is another object of this invention to separate a liquid from a gas using apparatus employing no moving parts.

It is a further object of the present invention to provide for the separation of oil from a compressed refrigerant gas in a manner which eliminates the need for a separate oil sump in an associated refrigerant compressor and which is capable of use with compressors of varying compression capacity.

It is still a further object of the present invention to provide a liquid-gas separator which, by splitting the flow of the liquid-gas mixture prior to the occurrence of the separation process, provides for a decreased surface area at the location in which the separation process occurs and which, therefore, provides for better sound attenuation such as might otherwise be achieved by the use of a discrete discharge line muffler.

It is another object of the present invention to provide a liquid-gas separator design which facilitates the "de-tuning" of the separator from the compressor with which it is associated to eliminate the development of unwanted frequencies in the separator which are associated with the frequencies developed in the compressor.

It is still another object of this invention to remove a predetermined amount of liquid from a liquid-gas mixture using centrifugal force generated by constraining the received mixture to travel along a predetermined spiroidal path.

Finally, it is an object of the present invention to provide easily fabricated and relatively inexpensive apparatus for efficiently separating and recovering entrained oil from the mixture discharged by a rotary screw compressor in a refrigeration system.

An appreciation of these and other objects of the present inventions will be gained when the following material is taken in consideration together with the attached drawing figures. The oil separator of our invention is a unitary tubular U-shaped housing having first and second upstanding tubular leg portions connected by a common sump portion.

Refrigerant gas, in which oil is entrained, is delivered from the discharge port of a compressor to flow splitting apparatus which divides and tangentially delivers separate, relatively equal portions of the mixture to the interior of each of the upstanding leg portions of the U-shaped housing. The delivery of the portions of the mixture into the legs of the U-shaped housing is therefore accomplished in a manner which immediately induces a swirling motion into the portions of the mixture entering the leg portions so as to cause the disentrainment of the oil from the mixture by centrifugal force.

The disentrained oil drains to a common base or sump portion of the separator by force of gravity. Open ended conduit penetrates and extends into the upper region of the tubular leg portions of the housing to a point generally below the level of entry of the gas-oil mixture which is delivered into the leg portions by the flow splitting apparatus.

The open end of such penetrating conduit is disposed generally in the axially central region of the tubular leg portions where, because of the disentrainment and draining of the oil which occurs along the inner side walls of the housing, relatively oil-free gas at discharge pressure is found. That gas, from which oil has been separated, is communicated out of the leg portions, through the conduit, under the impetus of the discharge pressure which is found within the interior of the separator whenever the compressor is operating. The gas passes through the open ended conduit penetrating each leg portion and is directed to the condenser of the refrigeration system in which the oil separator is employed.

The common sump portion of the separator, to which separated oil drains and in which the separated oil collects, is in flow communication with various locations within the compressor. The discharge pressure in the interior of the separator, which exists whenever the compressor is in operation, is employed to drive separated oil from the sump back to the compressor for re-use in the manner suggested above in the Background of the Invention.

The oil separator of the present invention provides for many advantages, some of which are readily apparent and others of which are somewhat surprising. Among the recognizable advantages of the oil separator of the present design are the reduced fabrication costs associated with it. This is particularly true with respect to the tubing which penetrates the legs of the separator. That tubing is tubing which already exists, in one form or another, as the conduit which connects the compressor to the condenser in a refrigeration system for the conveyance of compressed refrigerant gas therebetween. One not so obvious advantage to the oil separator of the present invention is that it does not fall within the definition of an ASME pressure vessel and is not, therefore, subject, because of its diameter, to various ASME requirements relating to pressure vessels.

Still another advantage of the present invention is the elimination of the need for a discrete oil sump within the compressor as well as the need for a compressor oil sump heater. Further, the separator of the present invention is conducive to use with compressors of widely varying capacities.

Finally, the oil separator of the present invention exhibits the somewhat surprising advantage of providing for better sound and frequency attenuation than its previous counterparts. Specifically, the splitting of the flow of the mixture from the compressor to the oil separator prior to the occurrence of the separation process decreases the surface area at the location of the occurrence of the separation process thereby resulting in better sound attenuation characteristics. These resulting characteristics are, in fact, similar to the characteristics of previous installations in which a discrete discharge line muffler is employed.

The "U"-shape of the separator housing also allows for the "tuning" of the separator to frequency decouple it from the compressor with which it is associated. By doing so the development of unwanted and possibly destructive frequencies within the separator resulting from frequencies associated with the operation of the compressor is prevented. The "U"-shape of the housing allows the oil separator of the present invention to be "tuned" to eliminate unwanted frequencies simply by adjusting the heights of its leg portions which has a negligible effect on the oil separation process.

DESCRIPTION OF THE DRAWING FIGURES

FIG. 1 schematically illustrates a refrigeration system according to the present invention.

DESCRIPTION OF THE PREFERRED EMBODIMENT

Figure 1:
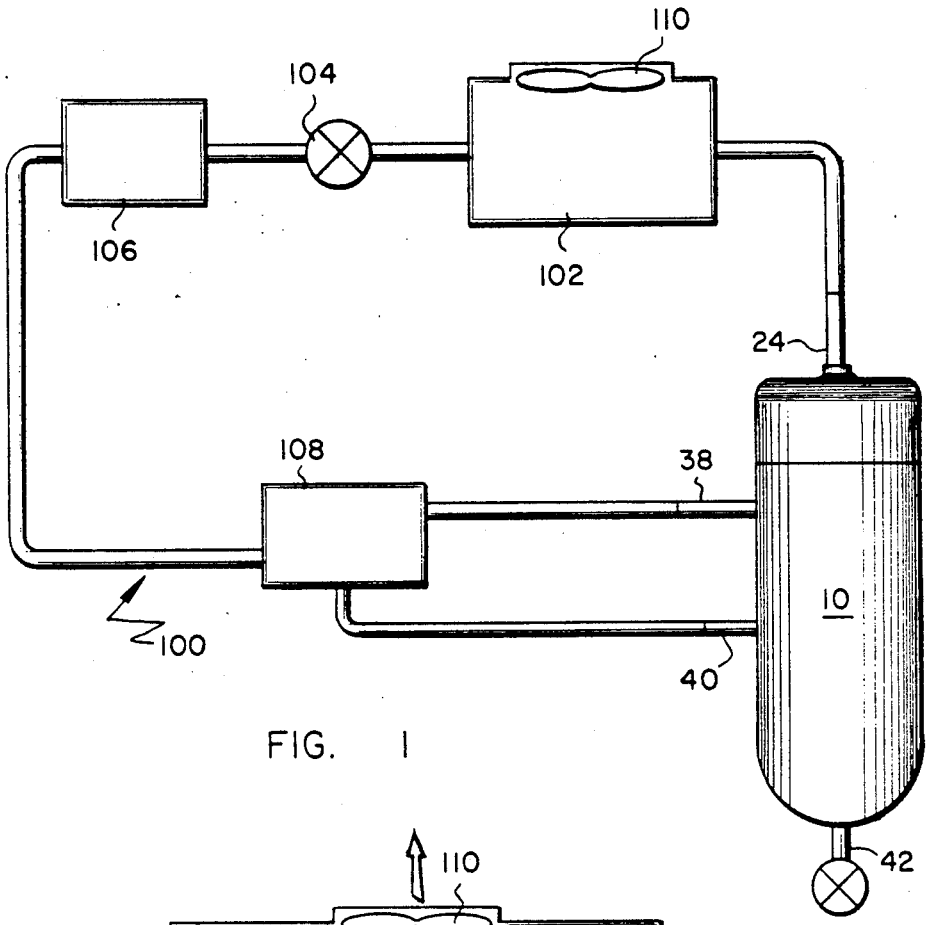
Figure 2:
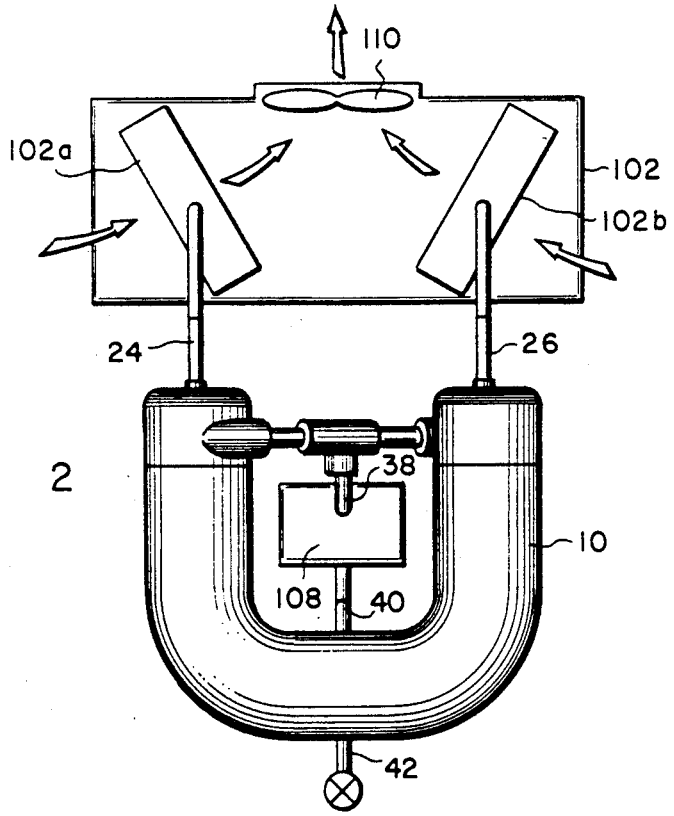
FIG. 2 illustrates the relationship of the oil separator of the present invention with the condenser of the refrigeration system of FIG. 1.
Figure 4:
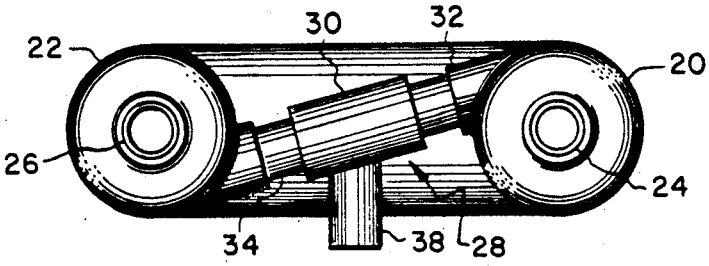
FIG. 4 is a top view of the oil separator of the present invention.

Referring initially to FIGS. 1 and 2, refrigeration system 100 includes an air-cooled condenser 102 from which condensed refrigerant gas is delivered, after passing through a metering device 104, to an evaporator 106. Vaporized refrigerant gas is delivered from evaporator 106 to compressor 108 which is preferably a screw compressor.

Condenser 102 is air-cooled and is preferably of the split type having separate heat exchange sections 102*a* and 102*b*. Fan 110 is disposed between condenser sections 102*a* and 102*b* so as to draw air through each of them in a heat exchange relationship with the compressed refrigerant gas which passes therethrough upon delivery of the gas to the condenser from oil separator 10.

Figure 3:
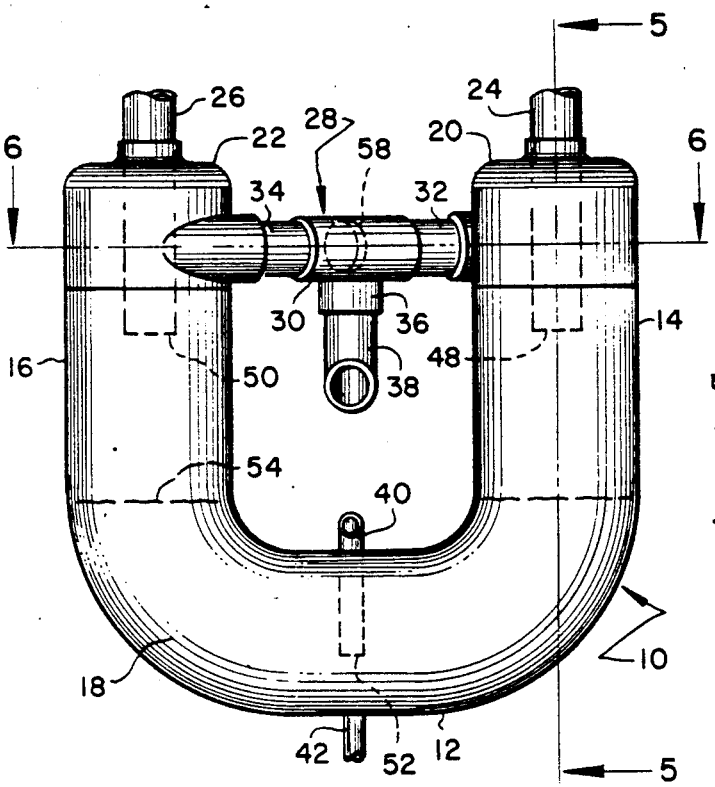
FIG. 3 is a perspective view of the oil separator of the present invention.
Figure 5:
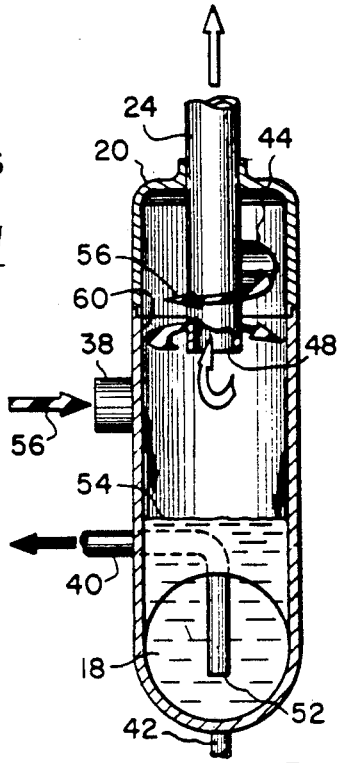
FIG. 5 is a cross sectional view of the oil separator of the present invention taken along line 5—5 of FIG. 3.
Figure 6:
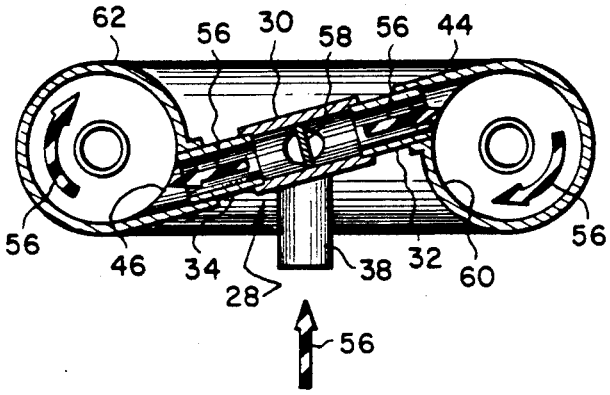
FIG. 6 is likewise a cross sectional view of the oil separator of the present invention taken along line 6—6 of FIG. 3.

Referring additionally now to FIG. 3, oil separator 10 is generally comprised of a tubular U-shaped housing 12 having first and second upstanding leg portions 14 and 16 respectively. The length of leg portions 14 and 16 is predetermined so as to de-tune separator 10 with respect to frequencies associated with the operation of the compressor from which it receives the mixture of oil and compressed refrigerant gas. This prevents, in a relatively simple and expeditious way, the development of unwanted and possibly destructive frequencies within the refrigeration system.

The likewise tubular portion of housing 12 which connects leg portions 14 and 16 defines a common oil sump 18 in its lower portion. It will be appreciated that housing 12 will preferably be a unitary structure fabricated from a single length of cylindrical tubing bent into a horse collar-like shape The upper ends of leg portions 14 and 16 are closed by caps 20 and 22 which define apertures through which conduits 24 and 26 penetrate- and extend into the interior central region of each of leg portions 14 and 16 of housing 12.

Also connecting between leg portions 14 and 16 is flow splitting apparatus 28 which internally divides the flow of the mixture of compressed refrigerant gas and oil received by separator 10 into relatively equal portions, as will be more fully described hereafter, for delivery to the leg portions of housing 12. Flow splitting apparatus 28 is comprised generally of a T-section 30 and conduits 32 and 34. T-section 30 has an entrance portion which is connected to conduit 38 through which the mixture of compressed refrigerant gas and entrained oil discharged from the compressor is directed into oil separator 10.

Sump 18 is penetrated by conduit 40 through which oil, which has been separated from the mixture of compressed refrigerant gas and oil discharged from the compressor, is directed out of separator 10 for re-use within the compressor. A drain connection 42, with shutoff valve, may be provided at the lowermost portion of sump 18 through which sediment or contaminated oil can be drained or oil samples taken.

Referring now to all of the drawing figures, it will be appreciated that flow splitting apparatus 28 is angled with respect to a plane passing through the center lines of tubular leg portions 14 and 16 of U-shaped housing 12. As a result, openings 44 and 46, through which the split flow of compressed refrigerant gas and oil enters leg portions 14 and 16 of the separator respectively, open in a tangential manner into the side walls of the leg portions.

That is, the portions of the split flow of compressed refrigerant gas and entrained oil passing out of conduit portions 32 and 34 of flow splitting means 28 are directed along the inner side walls of leg portions 14 and 16, generally tangent to the cylindrical volume defined by the leg portions, upon entry thereinto. As a result, the mixture of compressed refrigerant gas and entrained oil entering leg portions 14 and 16 is immediately imparted a swirling motion and follows a generally spiroidal path around and down the inside walls of the leg portions.

It will be noted that openings 44 and 46 in leg portions 14 and 16 are preferably at an elevation higher than the open-ended bottom faces 48 and 50 of penetrating conduits 24 and 26. Therefore, open-ended bottom faces 48 and 50 of conduits 24 and 26 are shielded from the oil-laden compressed refrigerant gas as it enters the respective leg portions.

It will also be noted that conduit 40 has an open end 52 disposed in the lower portion of oil sump 18 at a location below the nominal level 54 of oil which resides in the sump and that although, as illustrated, discharge conduit 38 rises up into entrance portion 36 of T.section 30, discharge conduit 38 and entrance portion 36 of flow splitting means 28 could optionally lie in a common horizontal plane. Finally, a baffle-like element 58 can be provided which assists in portioning the flow of refrigerant gas and oil internal of the flow splitting apparatus and which acts to direct the resultant streams of gas and entrained oil into connector conduits 32 and 34.

OPERATION

As mentioned above, flow splitting means 28 is angled with respect to a plane passing through the axes of the preferably cylindrical leg portions 14 and 16 so that relatively equal amounts of the refrigerant gas and entrained oil (represented by arrows 56 in the drawing figures) exiting connector conduits 32 and 34 enters leg portions 14 and 16 tangentially through openings 44 and 46 along the inner side walls of the leg portions. The mixture entering the leg portions swirls around and follows a spiroidal path along the inner side walls 60 and 62 of the leg portions as it is generally drawn downward toward common sump 18 by force of gravity.

As will be appreciated, since the entrained oil within the mixture received through openings 44 and 46 is heavier than the compressed refrigerant gas in which it is entrained, the centrifugal force created by the swirling spiral flow of the mixture within the leg portion will cause the entrained oil to migrate radially outwardly within leg portions 14 and 16 and to impact, adhere and slide downwardly along inner walls 60 and 62. The separated oil then collects in sump 18.

It will also be appreciated that by providing for oil separation at two discrete locations within the separator, each of which communicates with a common sump, that should any clogging or other malfunction occur related to one separation area, the second area will continue to function thereby providing increased reliability with respect to the availability of oil for use in the compressor. Further, by splitting the flow a lesser volume of mixture is acted upon in each instance. As a result, the separation process for each portion of the mixture is more efficient as compared to a separation scheme in which the entire volume of the mixture discharged from the compressor is acted upon in one location or process and better sound attenuation is achieved. The need for discrete sound attenuation apparatus, such as a discharge line muffler, is thus eliminated.

The generally axially central region of the interior of tubular leg portions 14 and 16 will contain refrigerant gas from which oil has been disentrained as a result of the oil separation which occurs along the inner walls of the leg portions. Such gas is forced into open ends 48 and 50 of conduits 24 and 26 and which are above the nominal level of 54 in sump 18 by the continued entry of additional discharge gas (in which oil is entrained) into the upper region of the leg portions through openings 44 and 46. Continued entry of the oil-laden gas into the separator and the forcing of gas from which oil has been separated out of the leg portions through conduits 24 and 26 will continue to occur so long as compressor 108 is operating by virtue of the lower downstream pressure found in the refrigeration system.

The oil in sump 18 is likewise forced, by the discharge pressure which exists in the interior of the separator whenever the compressor is operating, through the open end 52 of oil supply conduit 40 to various compressor locations which require cooling, sealing and lubrication. Such locations, by design, are exposed, vent to or open into areas within the compressor which are at less than compressor discharge pressure so that both oil and refrigerant gas are driven from separator 10 and are delivered to locations at which they are next employed by differential pressure and without the need for mechanical assistance or moving parts. Optionally an oil pump (not shown) might be employed to move oil from sump 18 back to compressor 108.

While the refrigeration system oil separator of the present invention has been disclosed in a preferred embodiment. it will be appreciated that various modifications thereto might be made which are within the scope of the invention represented by it. Therefore, the scope of the present invention is to be limited only by the language of the claims which follow.

We claim:

1. A refrigeration system comprising:

an oil-injected screw compressor;

a condenser;

an oil separator disposed in said system in flow communication with each of said compressor and said condenser, said oil separator receiving a mixture of compressed refrigerant gas and entrained oil from said compressor and internally splitting said mixture for further delivery to two discrete locations within said separator where separate centrifugal oil separation processes occur, said oil separator defining a common sump for the oil separated at said discrete locations;

an evaporator; and a metering device, said compressor, said condenser, said oil separator, said evaporator and said metering device being connected for refrigerant flow.

2. The refrigeration system according to claim 1 wherein said oil separator has a generally U-shaped housing having first and second generally upstanding leg portions connected by said common sump.

3. The refrigeration system according to claim 2 wherein said separator includes means for splitting the flow of said mixture received from said screw compressor, said means for splitting flow communicating a portion of said mixture into each of said leg portions of said U-shaped housing.

4. The refrigeration system according to claim 3 wherein said U-shaped housing is a unitary tubular member.

5. The refrigeration system according to claim 4 wherein said oil separator includes conduit means extending into the interior of each of said leg portions of said U-shaped housing for communicating refrigerant gas, from which oil has been separated, out of each of said leg portions to said condenser.

6. The refrigeration system according to claim 5 further comprising conduit means for communicating separated oil from said sump to said compressor for use therein.

7. The refrigeration system according to claim 6 wherein said means for splitting flow communicates said portions of mixture received from said compressor tangentially into each of said leg portions of said U-shaped housing along the inner side walls thereof.

8. The refrigeration system according to claim 7 wherein said means for communicating refrigerant gas out of said U-shaped housing comprises open-ended conduit extending into the interior of each of said tubular leg portions to a position generally in the axially central region of said leg portions and above the nominal level of oil in said sump, said open-ended conduit being in flow communication with said condenser.

9. The refrigeration system according to claim 8 wherein said means for splitting flow delivers said portions of said mixture into said leg portions generally above the open-ends of said open-ended conduit for communicating refrigerant gas out of said housing to said condenser.

10. The refrigeration system according to claim 9 wherein said means for splitting includes a baffle-like element interior thereof for facilitating the portioning of said mixture for delivery to said leg portions.

11. The refrigeration system according to claim 10 wherein said means for splitting comprises a T-section into which said mixture is communicated and two conduits, one each of which connects said T-section to a different one of said leg portions of said U-shaped housing.

12. An oil separator for use in a refrigeration system employing a compressor comprising:

a generally U-shaped housing having first and second generally upstanding leg portions connected by a common sump portion;

means for splitting the flow of a mixture of refrigerant gas and entrained oil received from said compressor, said flow splitting means communicating a portion of said mixture into each of said leg portions; and means extending into the interior of each of said leg portions for communicating refrigerant gas, from which oil has been separated, out of each of said leg portions.

13. The oil separator according to claim 12 wherein said U-shaped housing is a unitary tubular member.

14. The oil separator according to claim 13 further comprising conduit means for communicating separated oil from said common sump back to said compressor for further use therein.

15. The oil separator according to claim 14 wherein said means for splitting communicates said portions of mixture tangentially into each of said leg portions of said housing along the inner side walls thereof.

16. The oil separator according to claim 15 wherein said means for communicating refrigerant gas out of said housing comprises open-ended conduit extending into the interior of each of said tubular leg portions to a position generally in the axially central region of said leg portions above the nominal level of oil in said sump.

17. The oil separator according to claim 16 wherein said means for splitting delivers said portions of said mixture into said leg portions generally above the open-ends of said open-ended conduit.

18. The oil separator according to claim 17 wherein said means for splitting includes a baffle-like element interior thereof for facilitating the portioning of said mixture received from said compressor for further delivery to said leg portions.

19. The oil separator according to claim 18 wherein said means for splitting comprises a T-section into which said mixture is communicated and two conduits, one each of which connects said T.section to a different one of said leg portions of said housing.

20. A method of separating oil from the mixture of compressed refrigerant gas, in which oil is entrained, which is discharged from a screw compressor to an oil separator in a refrigeration system comprising the steps of:

delivering said mixture at compressor discharge pressure to said oil separator;

splitting the flow of said mixture into relatively equal portions prior to separating said oil therefrom;

delivering each of said split portions of said mixture to a different location internal of said oil separator;

imparting a swirling motion to each of said portions of said mixture at each of said different locations internal of said separator so as to centrifugally disentrain oil from each of said portions of said mixture at each of said different locations;

collecting the oil disentrained from each of said portions of said mixture at each of said different locations in a common sump; and driving said disentrained oil and said gas from which said oil has been disentrained out of said oil separator under the impetus of compressor discharge pressure.

* * * * *